United States Patent [19]

Simson

[11] Patent Number: 4,650,008

[45] Date of Patent: Mar. 17, 1987

[54] PILE DRIVER AND EXTRACTOR

[75] Inventor: Dionizy Simson, Winterthur, Switzerland

[73] Assignee: Simson and Partner, Winterthur, Switzerland

[21] Appl. No.: 652,011

[22] Filed: Sep. 19, 1984

[30] Foreign Application Priority Data

Sep. 19, 1983 [CH] Switzerland ..... 5081/83

[51] Int. Cl.[4] ..... B25D 9/04

[52] U.S. Cl. ..... 173/91; 173/134; 173/162 R; 173/116; 175/56; 91/216 B; 92/117 A

[58] Field of Search ..... 173/14, 16, 112, 113, 173/116, 119–121, 142, 90, 134–136, 162 R, 125; 175/56; 405/232; 91/216 R, 216 B, 40, 196; 92/117 A, 85 B, 110, 111, 117 R

[56] References Cited

U.S. PATENT DOCUMENTS

| | | | |
|---|---|---|---|
| 3,004,389 | 10/1961 | Muller | 175/56 |
| 3,262,507 | 7/1966 | Hansen | 175/56 |
| 3,529,681 | 9/1970 | Berrie | 173/116 |
| 3,745,885 | 7/1973 | Fair et al. | 91/216 |
| 4,026,193 | 5/1977 | Olmstead | 91/216 B |
| 4,178,838 | 12/1979 | Stafford | 92/117 A |
| 4,382,475 | 5/1983 | Suzuki | 173/134 |

FOREIGN PATENT DOCUMENTS

| | | |
|---|---|---|
| 2732934 | 1/1979 | Fed. Rep. of Germany . |
| 594111 | 12/1977 | Switzerland . |

*Primary Examiner*—Donald R. Schran
*Assistant Examiner*—James L. Wolfe
*Attorney, Agent, or Firm*—Oblon, Fisher, Spivak, McClelland & Maier

[57] ABSTRACT

A driving and extracting apparatus has a hammer frame within which a reaction mass is freely movable. The reaction mass is caused to reciprocate within the hammer frame by the selective application of drive pressure to opposite drive cylinders at a frequency corresponding to the natural frequency of the mass. A pneumatic spring at each end of the reaction mass prevents contact between the reaction mass and the ends of the hammer frame. Sensors in the hammer frame detect the position of the reaction mass and adjust the pneumatic springs accordingly.

4 Claims, 9 Drawing Figures

FIG. 2
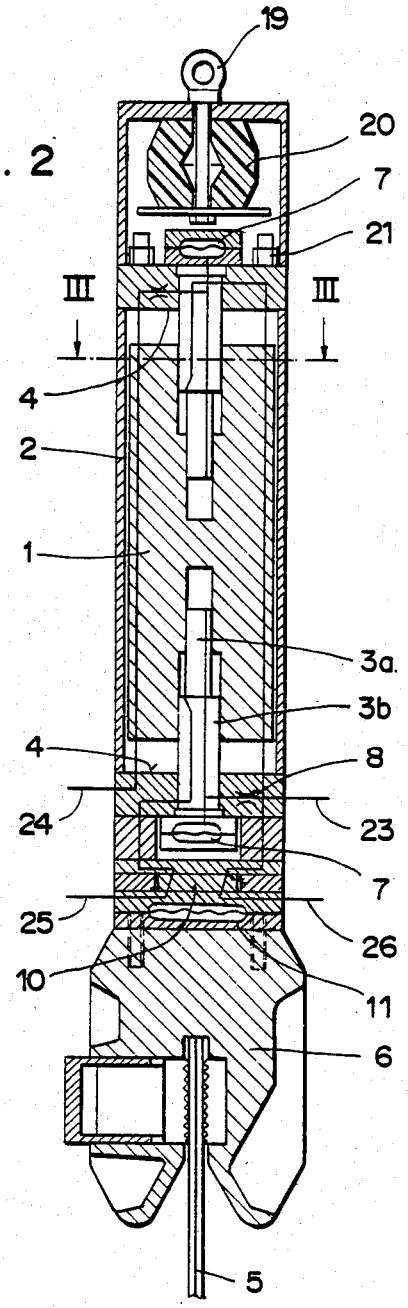
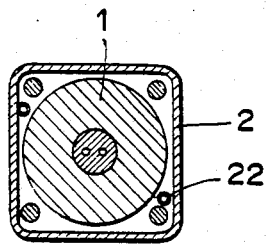
FIG. 3

C
C2
C1
C=f(ω)
ω1
ω2
ω f
f1
f2
f=f (ω)
ω1
ω2
ω

P
ΔP1
P1
ΔP2
P2
C=ΔP/ΔV
ΔV1
V1
ΔV2
V2
V

P
P2
P1
ω1
ω2
ω

PILE DRIVER AND EXTRACTOR

BACKGROUND OF THE INVENTION

1. Field of the Invention

This invention relates to equipment for driving or ramming and for extracting or hoisting piles and the like, and more particularly to driving and extracting apparatus of the type utilizing a vibrator having a reaction mass disposed freely movably within a hammer frame and alternately exposed on opposite sides to drive pressure, on the one hand, and to spring pressure, on the other hand. Such apparatus is intended to be used for driving piles or pile-like material, such as sections of sheet piling, into the ground by initiating forces acting periodically on the plle material in the longitudinal direction thereof.

2. Description of the Prior Art

Apparatus of this type has already been proposed, e.g., in West German Published Application (DAS) No. 2,732,934. Such apparatus makes use of the centrifugal force of rotating flyweights driven electrically or hydraulically, or of reaction forces of masses moved translationally by hydraulic means. One drawback of this prior art apparatus is that during each cycle, the reaction mass is accelerated and then braked again by the pressure medium. As a result, the effective output is relatively low as compared with the propulsive output. In the drive of the reaction mass by means of the pressure medium alone, i.e., without taking into account the natural frequency of the reaction mass and or the passive masses (hammer frame, clamping device, pile material, and ground), it happens that the active mass moves in the opposite direction from the passive masses prior to the impact. This is not so disturbing in purely vibrational operation, but in striking, a large part of the impact energy is nullified in this way.

Apparatus has also been disclosed, e.g., in Swiss Pat. No. 594,111, in which a mass is mounted on springs and caused to vibrate by means of centrifugal forces, the exciting frequency being approximately the same as the natural frequency of the vibrating mass or being in resonance relation thereto. The mass thus vibrating strikes against a stop fixed to the pile material, and in this way the pile material is, on the one hand, set in motion by vibrations which are transmitted via the spring mounting and, on the other hand, driven into or extracted from the ground by the directed blows. Such equipment has the drawback that the impact frequency can be varied only by reconstructing the apparatus, i.e., by changing the springs and flyweights to a different frequency. Another disturbing factor is that the desired frequency must be one which is harmonic relative to the speed of rotation or the flyweights. At higher harmonic vibrations, the adaptation achieved is very unstable. In driving and extracting work, the energy requirement varies as a function of the depth to which the pile material penetrates into the ground. At shallow depths, it is preferable to work with high-frequency vibration, the noise level also being low in this case. With increasing depth of penetration, the lateral friction on the pile material becomes greater, as does the mass of the earth which moves along with it. In this case, greater energy pulses are more effective. The necessary driving depth can usually not be reached at all without impact, or the vibratory equipment takes on considerable dimensions, and the required power can amount to hundreds of kilowatts. Driving can better be carried out in friable ground by means of vibration, in cohesive ground by means of impact or impact-vibration. The power utilized is not optimally exploited. At a shallow depth of penetration and high amplitude, the whole arrangement tends to jump, penetration is slight, power consumption is low. At greater depths of penetration, the energy requirement often increases unpredictably, which leads to overloading of the drive facilities and can cause damage to the mechanical structure of the pile driver.

It is an object of this invention to provide an improved pile driver and extractor which makes it possible to save very considerably on energy.

To this end, in the driving and extracting apparatus according to the present invention, of the type initially mentioned, the reaction mass has drive and spring cylinders into which drive and spring pistons extend, the drive cylinder being connected to a pulsator, and the spring cylinder being connected to a pneumatic spring.

Preferred embodiments of the invention will now be described in detail below with reference to the accompanying drawings, in which:

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 is a vertical section through apparatus in a first embodiment of the invention, FIG. 3 is a section taken on the line III—III of FIG. 2.

DETAILED DESCRIPTION OF THE PREFERRED EMBODIMENTS

Figure 1:
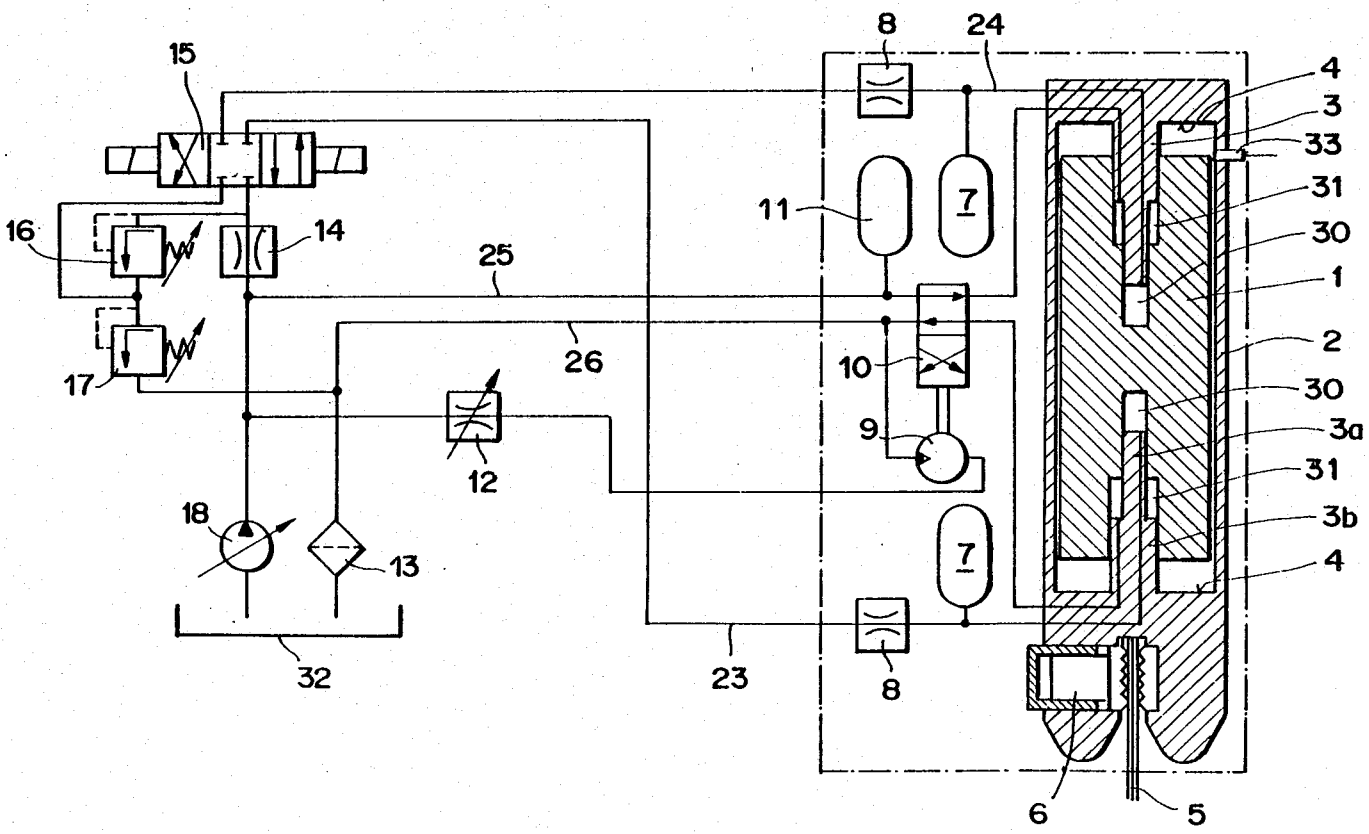
FIG. 1 is a diagrammatic representation of the apparatus.

The apparatus in the embodiment illustrated in FIGS. 1, 2 and 3 comprises a frame 2 which encloses reaction mass 1 on all sides and forms stops 4 at both ends. Disposed axially on stops 4 are two stepped pistons 3*a* and 3*b* through which respective connection lines 23 and 24 pass, establishing the communication between inner cylinder chambers 30 and a control valve 15. Pistons 3 also include two pressure-medium ducts 25 and 26, respectively, i.e., supply line 25 and runoff line 26, establishing the communication between outer cylinder chambers 31 and pneumatic springs 7. At the bottom, frame 2 has a clamping device 6 by means of which the entire apparatus is secured to pile material 5. At the top of hammer frame 2 is a suspension eye 19 with a shock-absorber 20. Situated between lower stop 4 and clamping device 6 are a pulsator 10 with its drive 9 and a pressure compensation chamber 11 connected to supply line 25. Directly connected to the two stepped pistons 3 (spring piston 3*a* and drive piston 3*b*) are the pneumatic springs 7. The two pressure-medium connections for springs 7 are provided with fixed, very narrow throttles 8. The entire hammer frame 2, which takes the form of a stacked structure, is screwed together into a unit by means of biased tie-rods 21. All internal medium-lines (e.g., line 22) are integrated within hammer frame 2.

At both ends of the roller-shaped reaction mass 1 there are axial stepped bores which form cylinders and, at the same time, also sliding and guide surfaces, as well as two cylinder chambers 30 and 31.

The drive consists of a pressure- and flow-regulated pressure source 18, a flow regulator 12 for the pulsator drive, a flow divider 14, a control valve 15, an adjustable pressure-differential valve 16, and a likewise adjustable pressure-regulating valve 17 for controlling the spring action. Both a pressure-medium filter 13 and pressure source 18 open at one end into a tank 32. Elastic lines connect the drive unit to the apparatus, runoff line 26 being provided with a filter 13. The drive unit may form a separate unit equipped with its own drive motor or, preferably, be integrated into the hydraulic power system of a crane or power shovel.

In general operation, pile material 5 is vibrated in under suitable conditions. With the output remaining constant, the frequency, and thus the amplitude, can be continuously adapted to the optimum driving conditions by influencing the number of pulses or the exciting force and simultaneously varying the elasticity constant so that the latter brings the natural frequency of a reaction mass 1 into conformity with the exciting frequency.

In positions other than the horizontal, the dead weight of reaction mass 1 is balanced in such a way that with the elasticity-constant sum remaining uniform, the biasing pressure of the spring mounting is so distributed that reaction mass 1 remains suspended between two stops 4. The approach of reaction mass 1 to a stop 4 triggers by means of a sensor 33 a control pulse which causes the vibrating reaction mass 1 to move away from the stop 4 by briefly switching on a pressure source.

Upon increasing driving resistance, the apparatus is put into impact operation in that reaction mass 1 is pushed out of the suspension state between the two stops 4 by means of a relatively slight force and is pressed against one of the stops 4. The way in which this takes place is that a control arrangement having sensor 33 which has been monitoring the suspension or reaction mass 1 is switched off, and the biasing pressure at two pneumatic volumes comprising pneumatic springs 7 is so modified that the elasticity-constant sum remains the same, but a slight force differential is produced. With this arrangement, the impact frequency and impact energy can be varied at will and adapted to the driving conditions while the output remains the same.

Reaction means mass 1 is mounted on the pneumatic springs 7, the elasticity constant of which is adapted to reaction mass 1 and to the exciting frequency in such a way that reaction mass 1 vibrates at its natural frequency. The energy supplied in the form of a pulsating flow of medium serves to eliminate frictional losses and is transmitted to the pile material 5 in the form of vibration or impact. Reaction mass 1 need not be braked by a pressure medium from the drive upon each change of direction and then accelerated again since it vibrates by itself, whereby a considerable saving on energy is achieved.

Owing to the spring mounting, reaction mass 1 is accelerated in a first phase by two forces, viz., by the medium-pressure from the drive and by the biased spring 7. During the movement of reaction mass 1 away from a given stop 4, the bias of spring 7 associated with that stop lessens and eventually changes from positive to negative, i.e., acting in opposition to the drive pressure. The passive masses are accelerated in the same direction in which the impact is also directed.

More specifically, the apparatus illustrated in FIGS. 1, 2 and 3 operates as follows: As soon as the apparatus is set upon pile material 5 and fixed thereto by means of clamping device 6, pressure source 18 is actuated, whereby a stream of pressure medium flows to a cylinder-piston unit in reaction mass 1 and moves the latter until the counterpressure in the pneumatic spring 7 situated on the opposite side of reaction mass 1 causes a counterpressure of the same magnitude as the drive pressure. At the same time, a second stream of pressure medium flows via flow regulator 12 to the pulsator drive. Pulsator 10 is set in motion and changes the drive flow of the pressure medium over into the cadence preset at the flow regulator. Reaction mass 1 moves in the opposite direction until the biasing force of the second spring is once again in equilibrium with the drive force. This is repeated as long as the predetermined value at a control unit (not shown) is not changed manually or via automatic evaluation of a signal, e.g., of the rate of penetration, or else by means of a program. When the predetermined value is changed, flow regulator 12 is so readjusted that the desired frequency is achieved. At the same time, the elasticity constant is also adapted to the new frequency. Pressure regulating valve 17, through which a third stream limited via flow divider 14 flows, adjusts the pressure to a predetermined value, and at the same time the pressure change is conveyed over lines to both pneumatic springs through the actuated control valve 15. Via the narrow fixed throttles 8, the mean bias pressure in springs 7 is assimilated to the preset pressure. As soon as the desired condition is reached, control valve 15 returns to the middle position and blocks the lines. During vibration operation, control valve 15 is briefly actuated whenever the reaction mass comes too close to one of the two stops 4. By means of a signal from one of the sensors 33, control valve 15 is triggered in such a way that on the side in question, overpressure is supplied for a short time until reaction mass 1 moves away from the vicinity of the stop 4.

Pressure differential valve 16 has the task of producing a difference in pressure between the springs 7. This is necessary when the pile driving apparatus is in a position other than horizontal. The weight of reaction mass 1 must be balanced. During impact operation, the force pressing reaction mass 1 against stop 4, as well as the direction of impact, is determined by means of the difference in pressure via valve 16.

In order to protect the pressure source and the supply line from pressure surges, pressure compensation chamber 11 is disposed in immediate proximity to pulsator 10 and has the task of equalizing the pressure pulsation of the medium, which is under high pressure.

The natural frequency of a mass is a function of the size of the mass and the elasticity constant of the springs on which mass 1 is mounted:

$$\omega=(\Sigma C/m)$$

For a given mass, the natural frequency can be affected by modifying the elasticity constant.

Figure 4:
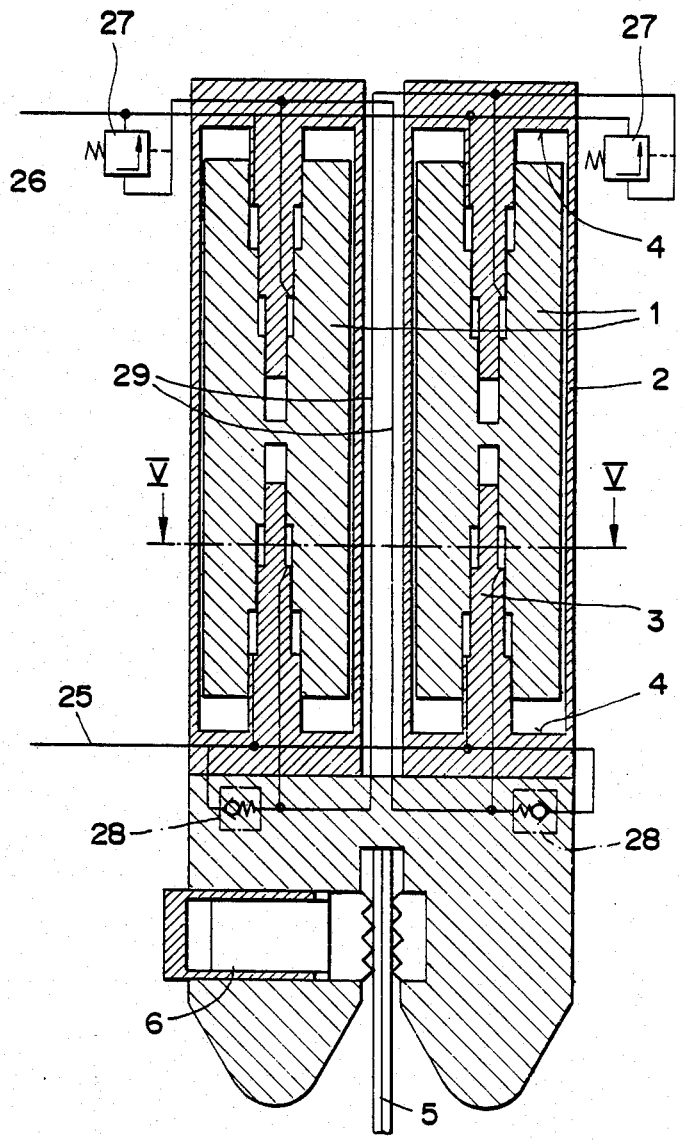
FIG. 4 is a vertical section through apparatus in a second embodiment of the invention, having two synchronized reaction masses.
Figure 5:
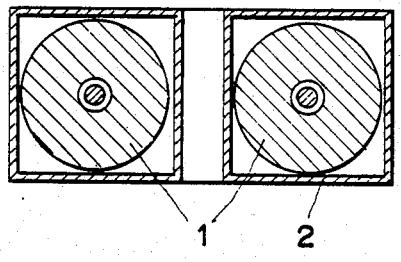
FIG. 5 is a section taken on the line V—V of FIG. 4, and FIGS. 6*a*–6*d* are a series of graphs showing the functions necessary for theoretical understanding of the invention.

FIG. 4 shows apparatus with two reaction masses 1. It differs from an embodiment having only one reaction mass 1 in that it comprises four three-step cylinder-piston units 3. The additional cylinders of the two reaction masses 1 are interconnected crosswise, each line being connected to pressure-medium supply line 25 by a check valve 28. When the apparatus is started up, the lines together with the cylinder chambers are filled with with the pressure medium via check valves 28. In order to allow the air in the lines and cylinder chambers to escape, cross-lines 29 are each equipped with a relief pressure valve 27 communicating with runoff line 26. In the event of a leak, more pressure medium can flow in through check valves 28; upon loss of the synchronization, the excess oil is pressed out of one of the cross-lines 29 via relief pressure valves 27 into the runoff. The overflow pressure adjusted is higher than the operating pressure of the drive, and both pressure relief valves 27 may also be regarded as safety valves.

FIG. *6a* shows the curve of the function $C=m\omega^2$. As the frequency increases, so does the elasticity constant.

With vibration of a given mass and with constant drive power, the deflection of the mass decreases. The curve or this function is shown in FIG. *6b*.

Figures 6A, 6B, 6C, 6D:
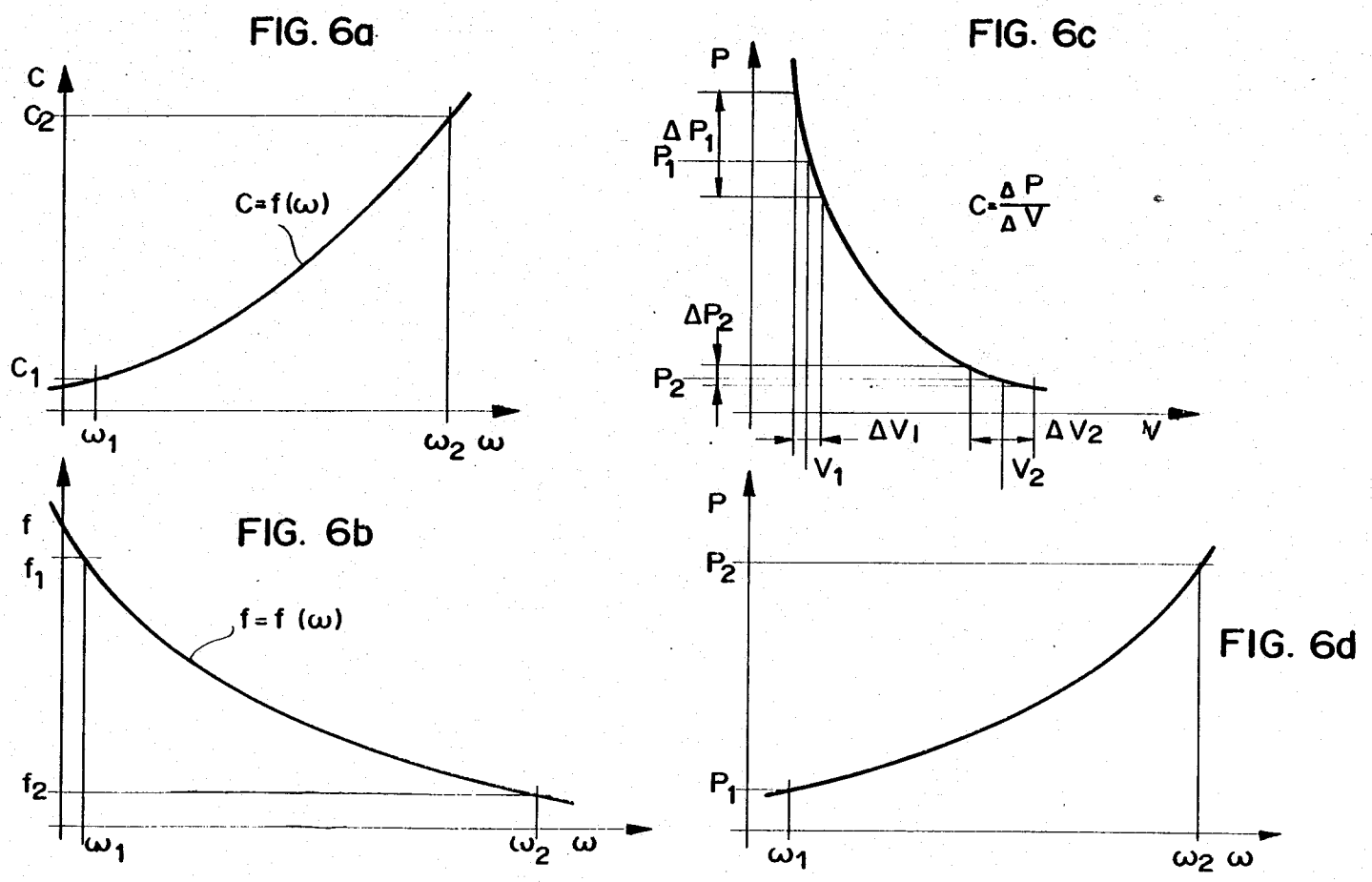

In a pressure reservoir, the pressure generated is a function of the volume by which the gas bubble is reduced:

$$p=(p_1V_1^{1.4}/V^{1.1})\ \text{(FIG. 6c)}.$$

In order to obtain a desired curve of pressure variation $$C=(\Delta p/\Delta V)$$

it suffices to introduce the bias pressure $p_n$ accordingly. In the case of variations of volume caused by the vibrating reaction mass by means of the appropriate cylinder-piston unit, pressure curves can be set which correspond approximately to the desired elasticity constant. The curve of this function is shown in FIG. *6d*.

In this way, it is possible to provide apparatus by means of which driving and extracting work can be carried out in an energy-saving manner, owing to the characterizing features of the present invention.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A driving and extracting apparatus comprising:
a hammer frame;
a reaction mass freely movable in said frame;
means defining a drive cylinder and a spring cylinder at each end of said mass;
means defining drive and spring pistons extending respectively into each of said drive and spring cylinders;
pulsator means for alternately communicating each of said drive cylinders with a source of drive fluid at a frequency corresponding to the resonant frequency of said reaction mass; and
means for communicating each of said spring cylinders with a pneumatic volume, said pneumatic volume comprising a pneumatic spring.

2. A driving and extracting apparatus comprising:
a hammer frame having a longitudinal axis;
a reaction mass freely movable in said frame in an axial direction;
a cylinder bore in each axial end of said reaction mass, each said cylinder bore having a first stepped shoulder;
a fixed piston extending into each said cylinder bore, each said piston including a second shoulder corresponding to said first shoulder of a corresponding said cylinder bore, thereby defining in each said cylinder bore a spring cylinder and a drive cylinder;
a pneumatic volume comprising a pneumatic spring and communicating with each said spring cylinder; and
a pulsator for alternately connecting each of said drive cylinder with a source of drive fluid at a frequency corresponding to the resonant frequency of said reaction mass.

3. The apparatus of claim 2 including a source of fluid under pressure, and means including restriction means for communicating said fluid with said spring cylinders.

4. The apparatus of claim 2 including two of said reaction masses positioned side by side, said cylinder bores of each said mass having two of said first stepped shoulders, each of said pistons having two of said second shoulders.

* * * * *